United States Patent [19]

Chorne

[11] Patent Number: 4,753,440

[45] Date of Patent: Jun. 28, 1988

[54] GOLF CLUB HEAD WITH VISUAL REFERENCE FOR ADDRESSING THE GOLF BALL

[76] Inventor: Robert Chorne, 160 E. Hawthorne Ave., Valley Stream, N.Y. 11580

[21] Appl. No.: 886,660

[22] Filed: Jul. 18, 1986

[51] Int. Cl.[4] ..... A63B 69/36; A63B 53/04

[52] U.S. Cl. ..... 273/164; 273/175

[58] Field of Search ..... 273/164, 183 D, 173, 273/174, 77 A, 63 C, 163 R, 167 J, 167 R, 169, 171, 175; D21/219, 220

[56] References Cited

U.S. PATENT DOCUMENTS

| | | | |
|---|---|---|---|
| D. 101,108 | 9/1936 | Ellingham | D21/220 |
| 722,927 | 3/1903 | Swift | 273/174 |
| 1,046,343 | 12/1912 | Smith | 273/164 |
| 1,409,966 | 3/1922 | Plant | 273/164 |
| 1,485,272 | 2/1924 | Kinsman | 273/164 |
| 2,463,798 | 3/1949 | Paisley | D21/219 |
| 3,266,805 | 8/1966 | Bulla | 273/77 A |
| 3,318,598 | 5/1967 | Ruskin | 273/63 C |
| 3,416,797 | 12/1968 | Pfau | 273/77 A |
| 4,591,160 | 5/1986 | Piragino | 273/173 |

FOREIGN PATENT DOCUMENTS

| | | | |
|---|---|---|---|
| 25564 | 12/1905 | United Kingdom | 273/164 |

*Primary Examiner*—George J. Marlo

[57] ABSTRACT

A golf club head to be used for an "iron" that in a preferred embodiment has on its angled face along a bottom edge an arrangement of vertically oriented adjacently located score lines or grooves and above these vertical grooves a non-vertical or slanted arrangement of grooves that in contrast with each other optically provide a modified 90 degree or horizontally oriented visual reference, in the form of a bar-like configuration, which greatly assists the golfer in positioning the golf club head in relation to the intended line of flight of the golf ball.

2 Claims, 1 Drawing Sheet

GOLF CLUB HEAD WITH VISUAL REFERENCE FOR ADDRESSING THE GOLF BALL

The present invention relates generally to improvements for a golf club head as used for an "iron" (and to be distinguished from a "wood"), in which more particularly the improvements consist of score lines or grooves so arranged on the angled or ball-striking face of the club head as to significantly assist the golfer in positioning the club head with respect to the golf ball that is about to be struck.

In playing golf, a position normally assumed is one in which the golfer is said to be "addressing" the golf ball preparatory to striking it with the head of the golf club. During this setting-up activity, it is important that the club head be placed as desired with respect to the golf ball, the options being (and using a clock face as a reference) "square" or perpendicular to the intended line of flight and thus at 12 o'clock, or "closed" and thus turned slightly toward 11 o'clock, or "open" and consequently turned slightly toward 1 o'clock. Whatever the selected position, it is desirable that the golfer be aware of the orientation of the golf club head to the golf ball and its intended flight, and that there not be any unintended misalignment or misorientation, such as occurs when the golfer intends a "square" relationship and the club head unintentionally is either "open" or "closed."

Broadly, it is an object of the present invention to provide an improved golf club "iron" head which during the "address" position of the golfer provides a clearly discernible visual reference that informs the golfer of the angular relationship of the golf club head to the intended line of flight of the golf ball. More specifically, it is an object to provide an arrangement of score lines or grooves on the angled face of the head seen by the golfer during "address," that somewhat in the way of an optical illusion provides a visual reference orientation that is horizontal, and thus in a direction most useful for setting up, although in the arrangement the score lines or grooves are not horizontal. Moreover, if the individual score lines or grooves were horizontally oriented, they would not optically provide a horizontal visual reference that would be effective for the purposes intended, and is probably the explanation why heretofore golf club iron heads are lacking in markings or visual cues that facilitate club head positioning.

An improved golf club iron head overcoming the foregoing and other shortcomings of the prior art is embodied in a golf club engageable at a proximal end by a golfer preparatory to being urged through a golf swing by the golfer and, of course, having at a distal end a head having a sole defining a bottom ground-engaging edge and a ball-striking face extending upwardly and at a selected angle rearwardly of said sole, said angle of the face being effective to provide the golfer with visibility of the surface of the face. The improvements in the golf club include plural vertically oriented grooves in the face spaced in adjacent relation to each other in close proximity above and along the sole so as to cooperate in providing a horizontally oriented bar-like visual reference to the golfer, whereby said visual reference in its horizontal orientation is advantageously used in aligning the golf club head preparatory to the swinging use of the golf club.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
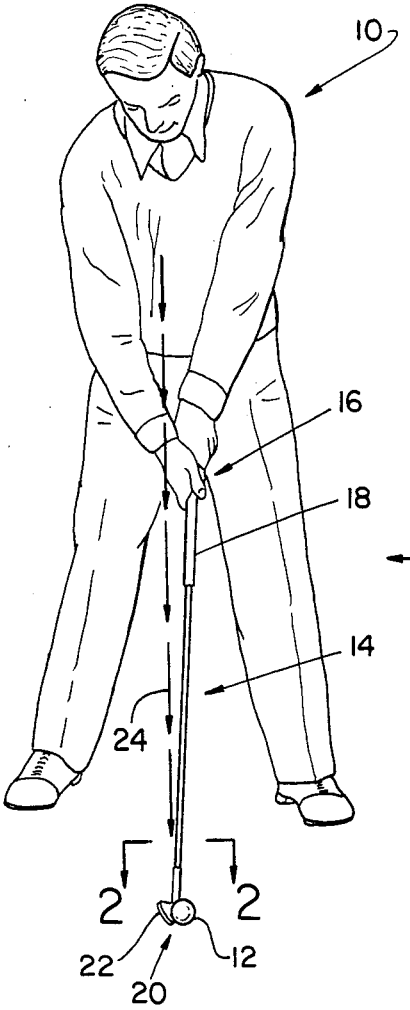
FIG. 1 is a front elevational view illustrating a golfer in his position commonly known as addressing the golf ball.

Referring to the drawings, and in particular to FIG. 1, there is shown a golfer 10 in a position normally assumed while playing golf in which the golfer is said to be "addressing" a golf ball 12 preparatory to urging a golf club, generally designated 14, through a golf swing. To do so, the golfer 10 engages the golf club 14 at a proximal end, at which more particularly the golf club is provided with a grip 18, and uses the distal end 20, at which more particularly there is a golf club head 22, to strike the golf ball 12 along an intended line of flight, all as will be more particularly explained in greater detail subsequently. As a preliminary, however, in understanding the improvements of the present invention, and still referring to FIG. 1, it will be further understood that while addressing the golf ball 12 that the golfer 10 is visually guided in this activity by sighting along the arrowed reference lines 24 and concentrates on what he sees of the golf club head 22 in relation to the golf ball 12, making whatever appropriate adjustments are necessary in the position of the golf club head 22 in relation to the ball 12.

Figure 2:
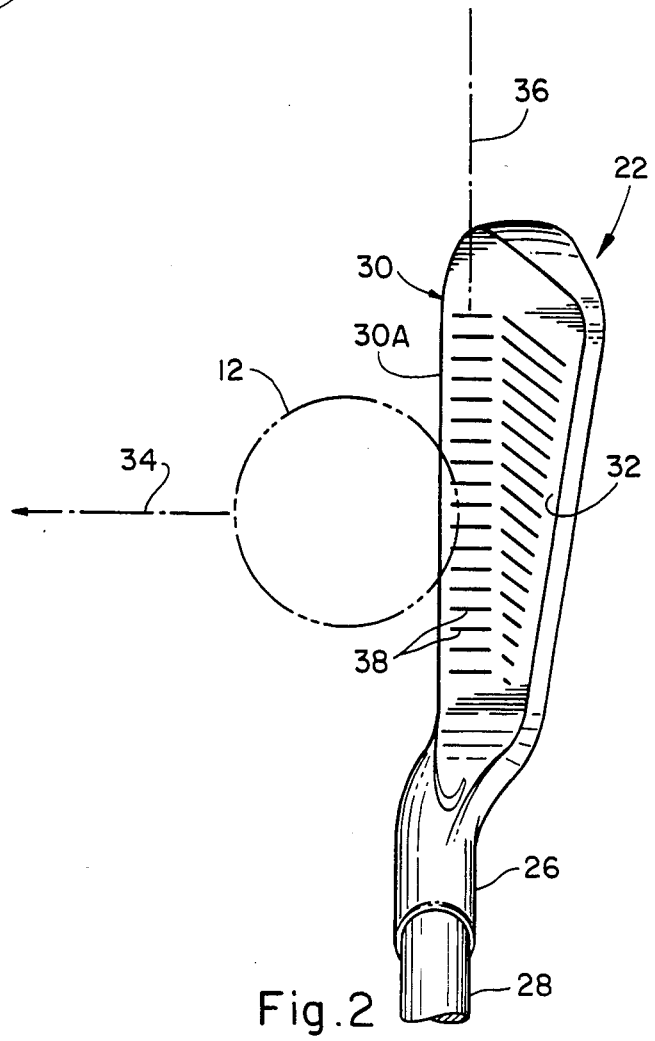
FIG. 2 is a partial plan view on an enlarged scale of the golf club head as seen along lines 2—2 in FIG. 1, in which the golf ball is shown in phantom perspective.

More particularly, and by now making reference to FIG. 2, it is intended to illustrate in this figure the visual image that is provided the golfer 10 while he is "addressing" the golf ball 12, and, most important, the option of adjustments that he can make in the golf club head 22 with respect to the golf ball 12. In the description of these options or adjustments available to the golfer, reference will be made not only to FIG. 2 but also to FIG. 3, since these two figures best illustrate the improvements which constitute the patentable advance of the present invention. Firstly, it will be understood that the construction material of the golf club head 22 is metal and that in golf parlance the golf club head 22 is known as an "iron" as distinguished from golf club heads that are usually constructed of wood and are thus known as "woods." The golf club head 22 (which further can be identified as a "#5" iron) was a hosel 26 which frictionally and adhesively receives therein the end of the golf club shaft 28. For purposes of fully describing and understanding the present invention, the golf club head 22, in addition to other structural features, includes a so-called sole 30 or bottom ground-engaging edge and a face 32, the latter being at a selected angle or loft and comprising the ball-striking surface of the club, these features just noted perhaps being best understood from FIG. 4. Thus, structure-wise, the head 22 is provided with a ball-striking face or surface 32 which extends upwardly and rearwardly at an angle from the sole 30, said angle being of a selected extent necessary to provide the golf ball with the necessary height and distance during its trajectory when struck by the golf club head 22 as part of the proper execution of the golf swing.

Referring now back primarily to FIG. 2, which illustrates what the golfer sees at the time of address, it is to be particularly noted that due to the rearward angle of the face 32 (which for a "5" iron is approximately 30 degrees) the golfer has a clear view, when sighting along lines 24, of the ball-striking surface 32. Contributing to the present invention is the understanding that the angled face 32 therefore provides a surface seen by the golfer and on which there can be advantageously provided, and which in accordance with the present invention there is provided, a visual reference which is advantageously used during address of the golf ball for adjusting the golf club head 22 in relation to the golf ball. More particularly, and as illustrated in FIG. 2 in conjunction with FIGS. 3 and 4, the golfer may be assumed to select an intended line of flight 34, and to this end would normally want to place the golf club head 22 so that the sole 30 is "square" or oriented perpendicularly of the intended line of flight 34. In accordance with the present invention, the improved golf club head 22 hereof provides a readily recognized visual reference line, identified as 36, by which the golf club head 22 is aligned to the golf ball 12 and to the intended line of flight 34.

Figure 3:
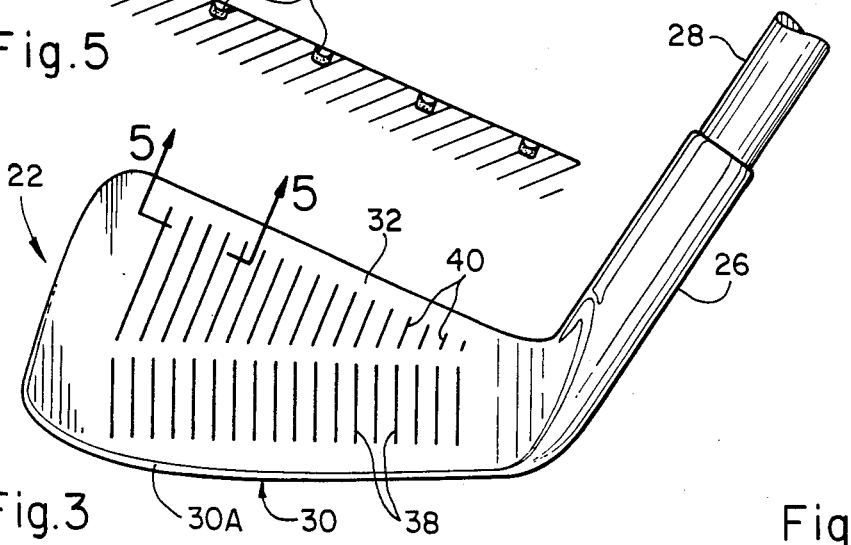
FIG. 3 is a front elevational view of the golf club head illustrated in FIG. 2 showing further structural details.
Figure 4:
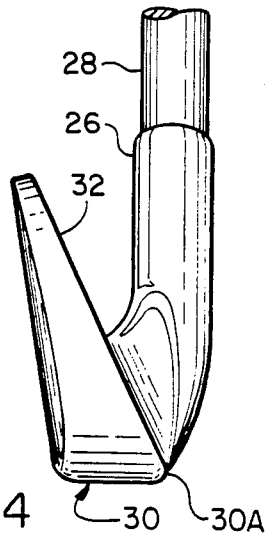
FIG. 4 is a left end elevational view of the golf club head.

Although the visual reference line 36 as just noted is horizontally oriented, as is perhaps best shown in FIG. 3 in conjunction with FIG. 2, said visual reference line is surprisingly provided by plural vertically oriented score lines or grooves, individually and collectively designated 38, which are spaced adjacent to each other above and along the visible front edge 30A of the sole 30. It has been found optically that the grooves 38 cooperate to provide a bar-like reference which is actually seen by the golfer 10 and of which the previously referred to reference line 36 is a readily imagined extension. In other words, collectively the score lines or grooves 38 provide, as is best illustrated in FIG. 2, a bar-like reference having the appearance of being horizontally oriented, which is supplemented, if need be, by the golfer imagining the linear reference line 36 which guides the golfer in his adjustment of the position of the golf club head 22 in relation to the golf ball 12, said position perhaps being "square" or perpendicular, such as illustrated in FIG. 2 or (using the face of a clock as a reference) a position in which the golf club head 22 can be placed slightly open, or turned towards 1 o'clock, or slightly "closed" or turned towards 11 o'clock. Whatever the adjustment, the visual reference provided by the series of score lines or grooves 38 is particularly note-worthy in visually informing the golfer 10 as he sights along lines 24 while addressing the golf ball, what the orientation is as between the golf club head 22 and the golf ball 12. Presently, a golfer intending to have the golf club head 22 "square" to the line of flight 34 might inadvertently have the golf club head either "open" or "closed" and not be aware of this misalignment or misorientation due to the absence of any visual reference on prior art golf club heads upon which he can be properly guided.

Figure 5:
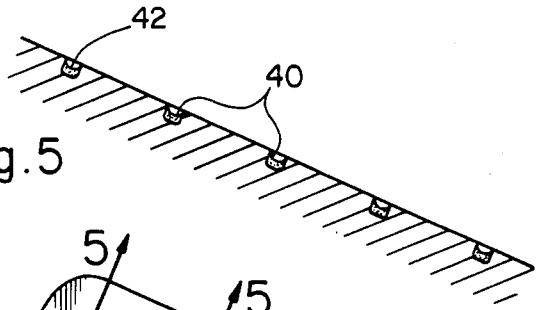
FIG. 5 is a sectional view taken along line 5—5 of FIG. 3 showing further structural details of the face of the golf club head.

To enhance the golfer's visibility of the grooves 38 and of the bar-like reference provided by these grooves, as just described, in a preferred embodiment there is deposited in these grooves paint, preferably white, black, or in some color which contrasts with the color (usually gray) of the metal construction material used in manufacturing the golf club head 22. Shown in FIG. 5 are other surface markings consisting of score lines or grooves, individually or collectively designated 40, which are not a part of the within invention but which are provided as a conventional structural feature to fill the entire surface of the face 32. As shown in FIG. 5, the grooves 40, like grooves 38, each have a deposit of paint 42 for enhanced visibility. There is a good contrast between a gray metal used for the construction of the golf club head 22 and white paint 42 deposited in the grooves 38 to achieve the inventive objective of providing a clear visual reference to the golfer 10 to assist the golfer in aligning the golf club head 22 in relation to the golf ball 12. It also has been found that the contrast between the non-vertical lines 40 and vertical lines or grooves 38 enhance the visibility of the latter, and thus contributes to the functioning of the grooves 38 as a setting up visual reference.

For completeness' sake, it is noted that in a preferred embodiment each score line or groove 38 should preferably be less than 0.035 inches wide and the minimum land or area between adjacent score lines should be less than three times the width of a score line. The just recited dimensions would be requirements for use of the within golf club during PGA or Professional Golf Association sponsored tournaments, but it is to be understood that the improved golf club head hereof is not intended to be used solely for tournament play but is also intended for non-professionals. In a preferred embodiment the uniform height of the plural grooves 38 is approximately 9/16 of an inch and said lines are at a maximum of approximately 3/16 of an inch above the sole edge 30A. It should be readily apparent from FIG. 3 that if the bottom and top ends of the lines 38 were connected by a line, that the connecting lines would be essentially horizontally oriented when the sole 30 is in its ground-engaging position at a time of address as assumed in FIG. 1.

For completeness' sake, it is also to be noted that the other score lines 40 need not be angularly oriented as illustrated, but that these lines can be horizontally oriented, or provided with some other orientation, or even omitted entirely, although the omitting of these score lines would not be advisable since they are believed to have some effect on the spin that is imparted to the golf ball.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. Improvements in a golf club engageable at a proximal end by a golfer preparatory to being urged through a golf swing by said golfer of the type having at a distal end a head having a sole defining a bottom ground-engaging edge and ball-striking face extending upwardly and at a selected angle rearwardly of said sole, said angle of said face being acute to the horizontal so as to provide a slanted orientation to said face which is effective to provide said golfer with visibility of the surface of said face, said improvements in said golf club comprising an arrangement confined to a location in close proximity above and along said sole of a continuous series of vertically oriented parallel grooves in said face spaced in adjacent relation to each other and having opposite ends located generally adjacent said sole and midway the height of said face, and additional parallel grooves in a non-vertical arrangement in said face above and in slightly spaced relation from said vertical grooves along said sole, whereby the visual contrast between said non-vertical and vertical grooves cooperate so that the vertical grooves have the appearance of providing a horizontally oriented bar-like visual reference to said golfer which is advantageously used in aligning said golf club head preparatory to the use of said golf club.

2. An improved golf club as claimed in claim 1 wherein the grooves of the head thereof have deposits of paint therein to enhance visibility of the bar-like visual reference provided by said grooves.

* * * * *